United States Patent [19]

Fisher et al.

[11] Patent Number: 4,487,360

[45] Date of Patent: Dec. 11, 1984

[54] TWO WAY ENVELOPE

[75] Inventors: Harland S. Fisher, Longmeadow; Wilfred H. Gendron, Wilbraham; Gregory Georgiades, Longmeadow, all of Mass.

[73] Assignee: Westvaco Corporation, New York, N.Y.

[21] Appl. No.: 363,547

[22] Filed: Mar. 30, 1982

[51] Int. Cl.[3] ..... B65D 27/06

[52] U.S. Cl. ..... 229/73; 229/92.3; 229/92.7

[58] Field of Search ..... 229/73, 92.1, 92.3, 229/92.7

[56] References Cited

U.S. PATENT DOCUMENTS

| | | | |
|---|---|---|---|
| 769,536 | 9/1904 | Dixon | 229/73 |
| 1,324,100 | 12/1919 | Binkowitz | 229/73 |
| 1,960,054 | 12/1934 | Johnson . | |
| 2,686,005 | 8/1954 | Hyman | 229/73 |
| 2,759,658 | 8/1956 | Sawdon | 229/73 |
| 3,086,695 | 4/1963 | Lillibridge | 229/73 |
| 3,113,716 | 1/1963 | Howard | 229/73 |
| 3,152,751 | 10/1964 | Hiersteiner | 229/73 |
| 3,184,150 | 5/1965 | Hubbard | 229/73 |
| 3,558,040 | 1/1971 | Krueger | 229/73 |
| 3,652,007 | 3/1972 | MacDougall | 229/73 |
| 3,802,618 | 4/1974 | Wiessner | 229/73 |
| 4,308,987 | 5/1982 | Solomon | 229/73 |

FOREIGN PATENT DOCUMENTS

| | | | |
|---|---|---|---|
| 784432 | 7/1935 | France | 229/92.7 |
| 21278 | of 1892 | United Kingdom | 229/92.1 |

*Primary Examiner*—Stephen P. Garbe

[57] ABSTRACT

The two way envelope of the present invention comprises front, rear and return panels that are joined together and folded to provide a semi-permanent fully enclosed pocket for the first mailing and a separate permanent fully enclosed pocket for the return mailing. The permanent pocket for the return mailing is formed by adhering the rear panel to the return panel. The semi-permanent pocket for the first mailing is formed by providing at least the front panel and one of the rear or return panels with side extensions that are adhered together. For return, the side extensions and the front panel are removed leaving intact the return envelope portion with its permanent pocket.

6 Claims, 20 Drawing Figures

TWO WAY ENVELOPE

BACKGROUND OF THE INVENTION

The present invention relates to a two way envelope that after its first mailing may be used to return an enclosure, payment or the like. Such envelopes when used for direct mail solicitation may be preaddressed and posted for return mail or may include a window through which a preaddressed insert can be displayed. In other cases, the return envelope is merely provided to promote a prompt remittance by the first addressee.

Many envelope styles have been developed for mailing bills, offers, statements or the like to potential clients or customers with features to facilitate the return mailing. In some instances a second envelope is provided inside the first envelope which may be used by the addressee to return a payment or a response to a request or offer. In other instances single blanks of envelope material have been designed, cut and folded to provide both the first and return envelopes. Such prior art envelopes have for the most part been successful, however many styles have encountered a variety of significant difficulties in manufacture and use. Some of the prior art envelopes of the latter class cannot be successfully manufactured on modern, high speed, automatic envelope machines. Also, many are not usable on automatic inserting equipment, nor can they be opened with the use of automatic opening devices or used with OCR (Optical Character Reader) scanning devices. Additionally, some of the known two way envelopes require difficult and tedious manipulation to convert the first envelope into its return form. Finally many of the known two way envelopes fail to provide within a single blank a completely enclosed pocket for the first envelope and a separate, completely enclosed pocket for the return envelope.

In contrast to the above, the envelope construction of the present invention solves many if not all of the problems inherent with the prior art styles of single blank two way envelopes, and does so with a unique construction that is suitable for all potential users.

SUMMARY OF THE INVENTION

The present invention is directed to a novel two way envelope that is cut and scored from a single blank of envelope material. The basic envelope construction includes separate, completely enclosed pockets for the first mailing and return. Each envelope pocket is provided with a closure flap, and where desired, the envelope for first mailing may include a windowed front wall useful for automatic insertion equipment, and the return envelope may include a self addressed, preposted format or a separate window for a return preaddressed insert.

The basic blank construction for preparing the envelope of the present invention includes a front wall, rear wall and return panel joined together along parallel edges. The return panel and rear wall are adhered together to provide a fully enclosed permanent pocket for return mailing, and the front wall and at least one of the rear or return panels include side extensions which are adhered together to provide a fully enclosed temporary pocket for the first mailing. The first envelope includes a closure flap foldably attached to the front wall and the return envelope includes a closure flap foldably attached either to the rear wall or the return panel. The closure flap for the return envelope may be formed from a portion of the front wall, the rear wall or may be foldably attached to the return panel. In addition, the front wall, rear wall and/or return panel may be provided with side flaps in addition to the side extensions, that are useful for forming the return envelope or for holding the envelope together for first mailing.

The two way envelope is formed by folding the return panel and rear panel together so that their inner surfaces lie in opposed relation. The return panel is adhered to the rear panel at the side edges thereof to form a permanent pocket for the return envelope. Subsequently, the front panel is folded to lie adjacent to the already formed return envelope and so that the inner faces of the front and rear panels lie in opposed relation separated only by the return panel. At this point, the side extensions attached to the front panel and one of the rear or return panels are adhered together to provide a temporary pocket for the first mailing. Upon receipt of the envelope by the addressee, the first envelope is detached from the return envelope by removing the side extensions and separating the front and rear panels along a perforated line provided in the blank for that purpose. The present invention includes several embodiments for accomplishing the results set forth above. However, in no event does the envelope require a complex manipulation for converting from its first mailing mode to its return mode. Depending upon the embodiment selected, the return envelope may be substantially the same size as the first envelope or smaller if desired.

Accordingly, it is an object of the present invention to provide a two way envelope useful for direct mail solicitation or business use for billing customers.

It is another object of the present invention to provide a two way envelope adapted to be manufactured, stuffed and sealed on high speed automatic envelope making and insertion equipment.

It is a further object of the present invention to provide a two way envelope of simple yet flexible design that is easily prepared for return mail by the first addressee.

It is another object of the present invention to provide a two way envelope having a window in the first panel through which address information may be displayed for the first mailing, and which may include a pre-addressed and posted return panel or windowed rear panel for convenient remailing.

Yet another object of the present invention is to provide such an envelope with separate, completely enclosed pockets for first and return mailing.

A further object is to provide such an envelope which may be constructed from a single blank of envelope material yet which can be used with bar code printing and OCR scanning.

These and other objects may become apparent from a consideration of the following detailed description, drawing and claims.

DESCRIPTION OF DRAWING

FIG. 5(*a*) is a partial plan view showing the preferred construction for the top portion of the envelope blank of FIG. 5;

DETAILED DESCRIPTION

Figure 1:
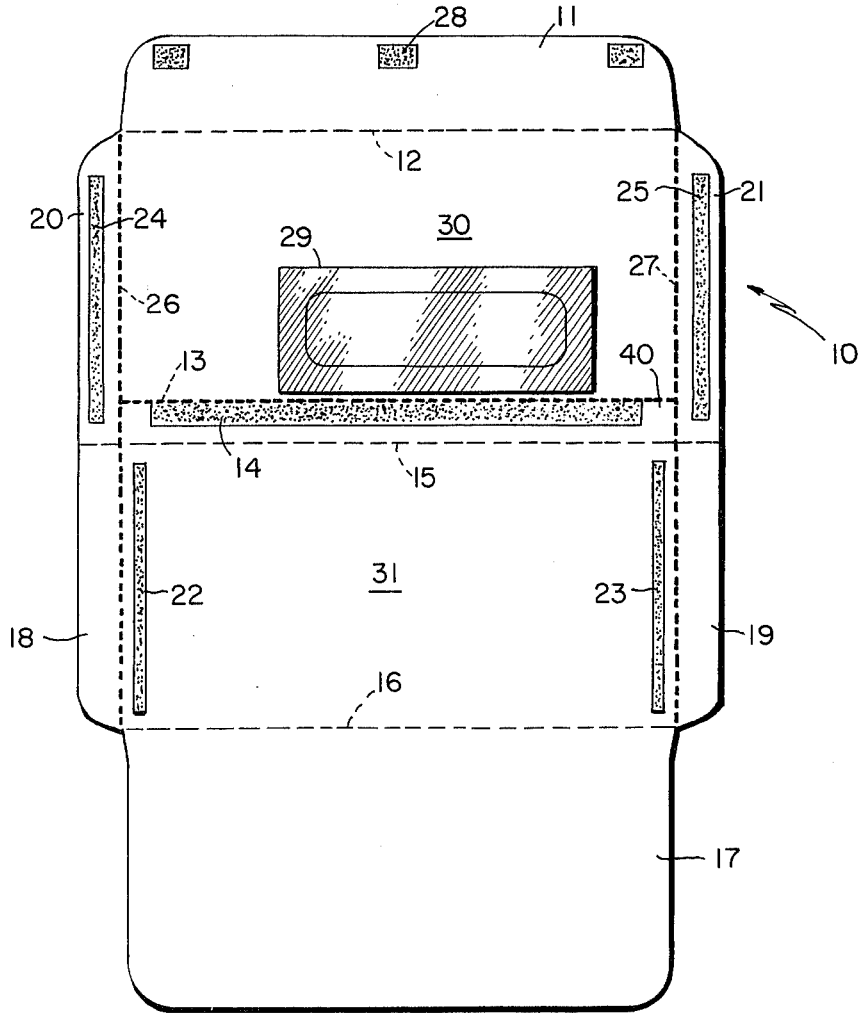
FIG. 1 is a plan view of a preferred embodiment of the blank structure used to make the envelope of the present invention.
Figure 2:
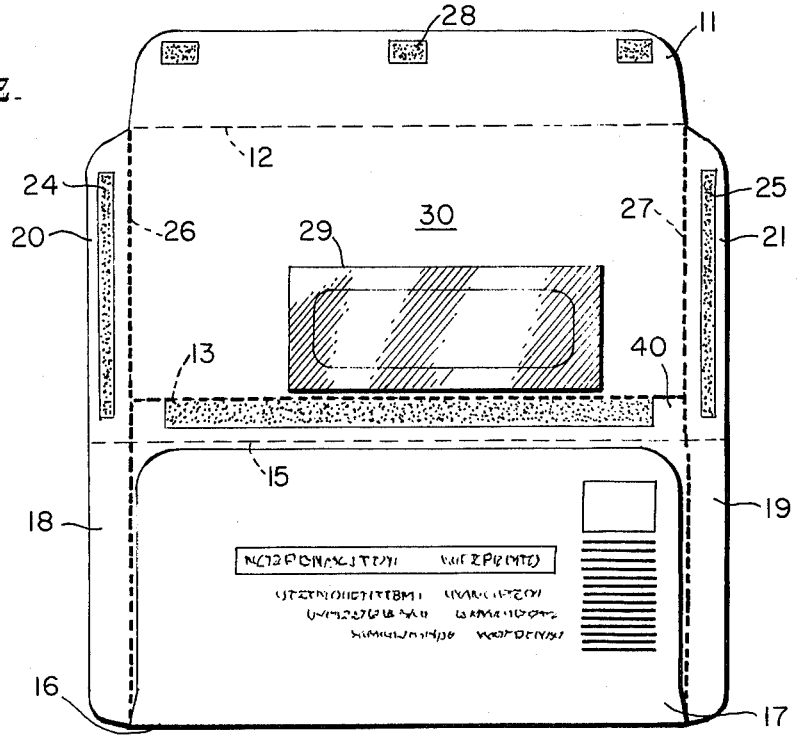
FIG. 2 shows the first foldng step in the assembly of the envelope from the blank of FIG. 1.

Referring to the drawing, the two way envelope of the present invention is generally formed from a blank 10 as shown in FIG. 1. The blank has an inner surface and outer surface (inner surface shown in FIG. 1), and includes a front panel 30 having side, top and bottom edges; a rear panel 31 having side, top and bottom edges; and, a return panel 17 having side, top and bottom edges. The bottom edges of the front and rear panels 30, 31 are joined together along a fold line 15 and the return panel 17 is foldably attached to the top of rear panel 31 along a fold line 16. Adhesive is applied at 22, 23 on the side edges of rear panel 31 so that when return panel 17 is folded about score line 16 and adhered to panel 31 as shown in FIG. 2, a permanent and completely enclosed pocket is formed for the return envelope portion of the two way envelope structure.

Figure 3:
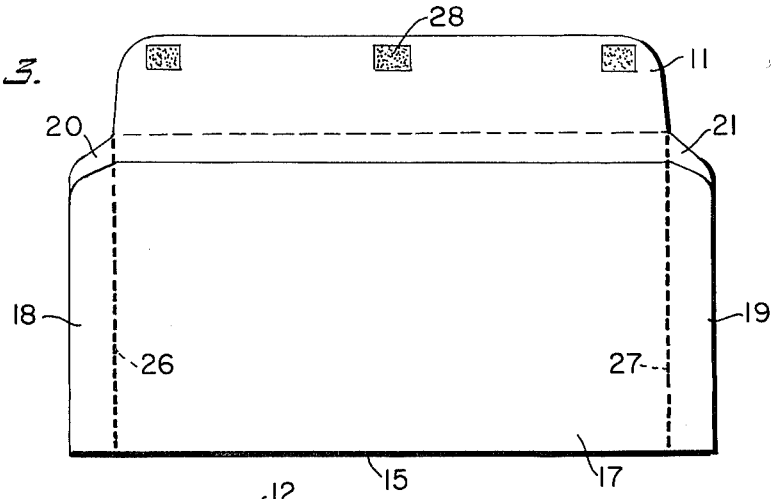
FIG. 3 shows the second folding step in the assembly of the envelope.
Figure 4:
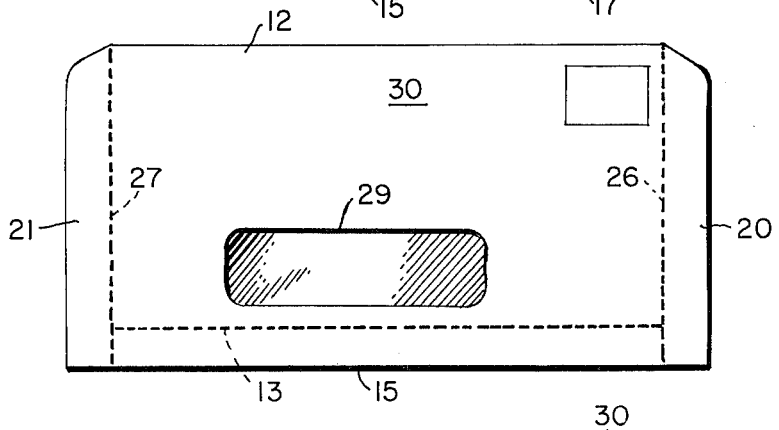
FIG. 4 is a front view of the envelope constructed from the blank of FIG. 1.

At the top of front panel 30, a first closure flap 11 containing adhesive patches 28 is foldably connected thereto along score line 12. Meanwhile, at the side edges of front panel 30 and rear panel 31, paired side extensions 20, 21 and 18, 19 respectively, are detachably connected thereto along perforated lines 26, 27. Adhesive strips 24, 25 are applied to the side extensions 20, 21 for the purpose of adhering the side extensions together (as shown in FIG. 3), to form the first mailing envelope structure. In this manner, a temporary completely enclosed and separate pocket is formed for the first envelope between the inner surface of front panel 30 and outer surface of return panel 17. Meanwhile, returning to the blank 10 of FIG. 1, it will be noted that front panel 30 is applied with a transverse perforated line 13 extending between parallel perforated lines 26, 27. The perforated line 13 is applied to the blank to form a line of demarcation along which the front panel 30 may be detached when the return envelope is to be used. The area 40 between the perforated line 13 and the score line 15 forms the return closure flap and is applied with a strip of adhesive 14. FIG. 4 illustrates the front of the fully formed and sealed envelope shown in FIG. 3 for first mailing. Note that the perforated line 13 appears in the front panel 30 below a window opening 29 that is used when a preaddressed insert is included in the first mailing. It will be apparent from a comparison of FIGS. 2 and 4 that the return envelope portion of the two way envelope has about the same height from top to bottom as the first envelope since the second or return closure flap 40 is formed from a portion of front panel 30. The manner in which the envelope of FIG. 4 is prepared for return use is not shown, but it is substantially the same as that disclosed hereinafter in connection with the description of FIGS. 5–8.

Figure 5:
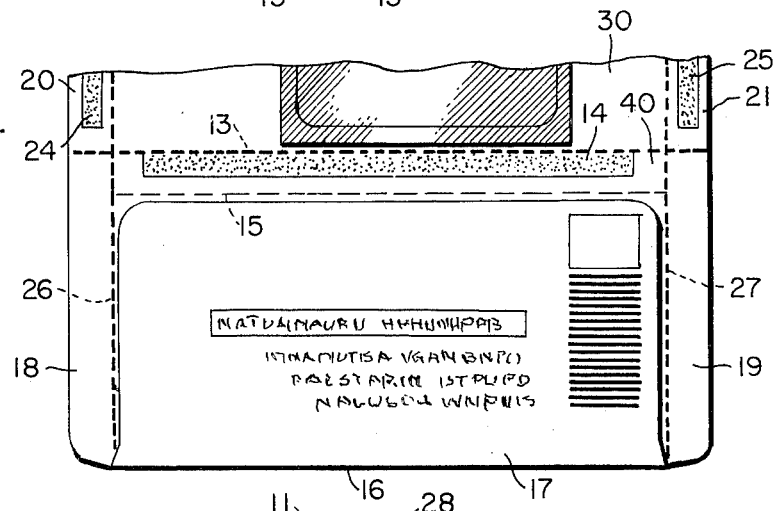
FIG. 5 is a partial plan view, showing the first folding step, of a modified blank construction for the envelope of the present invention.
Figure 5:
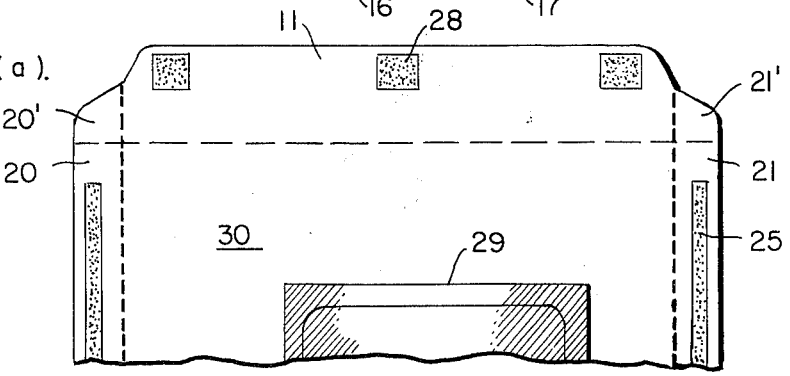

The envelope blank shown in FIGS. 5 and 5(*a*) has the same basic components illustrated in FIG. 1 and like reference numerals are used to identify like elements. FIG. 5(*a*) illustrates the preferred style for the first closure flap 11 which includes portions 20' and 21' of the side extensions 20, 21 attached to the edges of closure flap 11. However, as shown in FIG. 5, the return panel 17 has a lesser height than the rear panel 31. This arrangement enables the second or return closure flap 40 to be formed from a portion of rear panel 31. For this purpose, the front and rear panels 30, 31 are foldably connected together along perforated line 13, and score line 15 is moved downward into rear panel 31. This style will be particularly useful with the bar code printing and OCR scanning devices that are anticipated with the introduction by the U.S. Postal Service of the expanded zip code. For instance, the front panel of the outgoing envelope may be conveniently applied with a bar code to facilitate sorting and delivery. Subsequently, after delivery, the recipient removes the front panel leaving no residual code to interfere with the reading and sorting of the return mail coding. Accordingly it will be seen that the envelope style shown in FIGS. 5 and 5(*a*) has a distinct advantage over those two way envelopes which do not have separable components.

Figure 6:
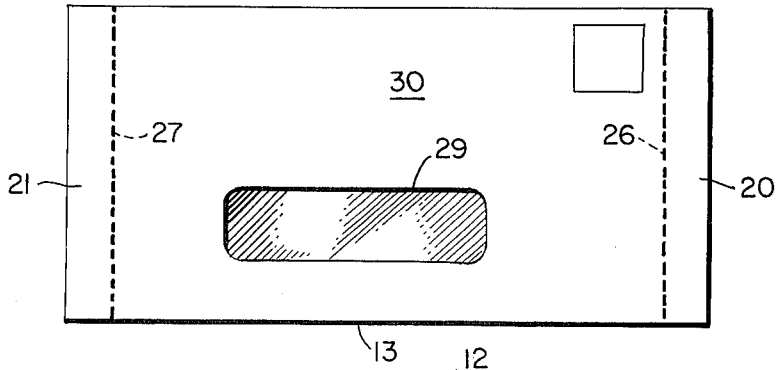
FIG. 6 is a front view of the envelope constructed from the blank of FIG. 5.
Figure 7:
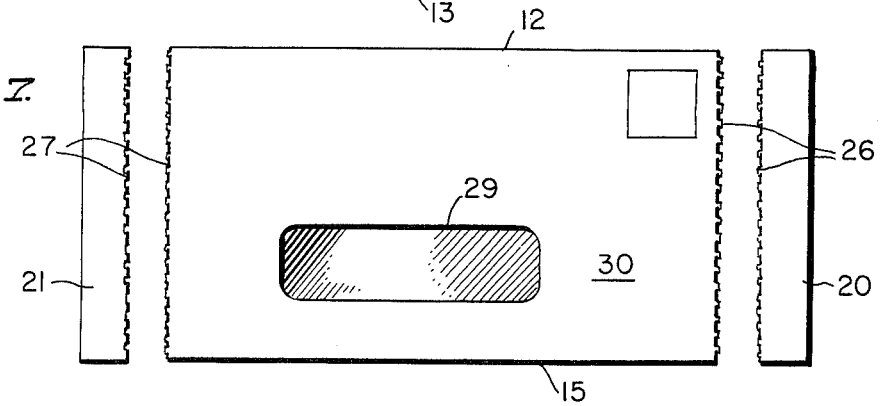
FIG. 7 shows the first envelope partially detached for remailing.
Figure 8:
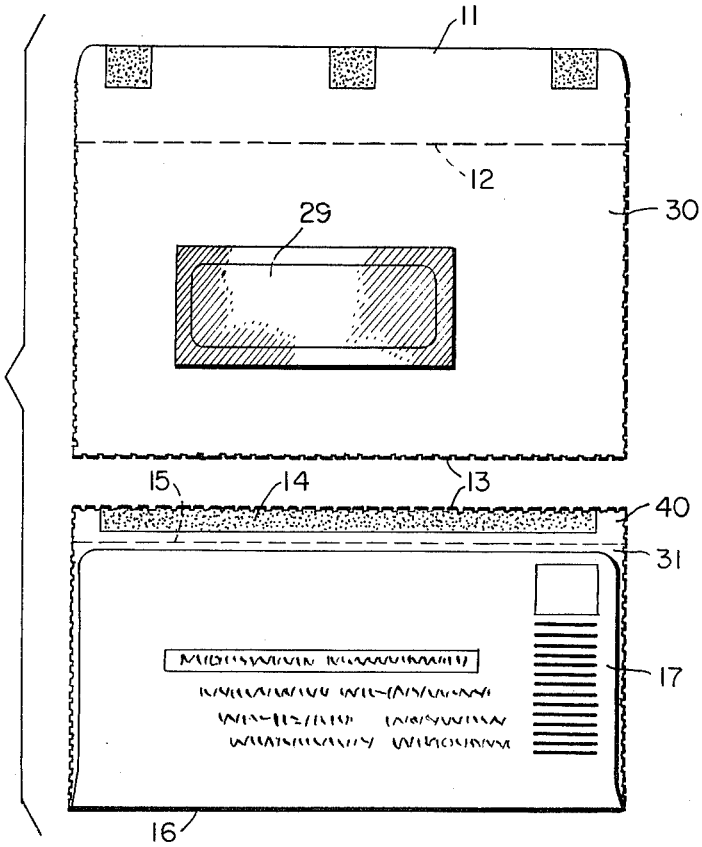
FIG. 8 illustrates the front panel detached from the rear panel to complete the formation of the return envelope.

The front of the envelope formed from the blank of FIG. 5 is shown in FIG. 6. Upon receipt by the first addressee, the envelope is opened by removing the side extensions 18, 21 and 19, 20 along perforated lines 26, 27 as shown in FIG. 7. This step effectively eliminates the first temporary mailing pocket so that the front panel 30 can be removed from the rear panel 31 along perforated line 13 as shown in FIG. 8. At this point, the return envelope is ready for use with its separate permanent pocket. For convenience, FIG. 8 shows the return panel 17 as being pre-addressed and posted for return.

Figure 9:
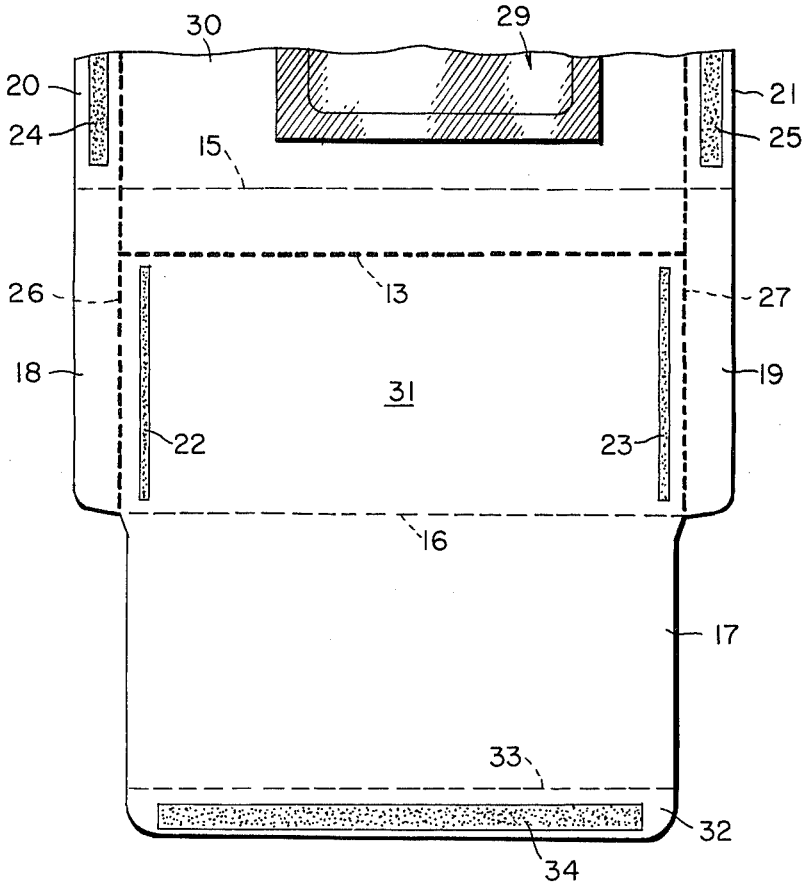
FIG. 9 is a partial plan view of a second modification for the blank used to construct the envelope of the present invention.
Figure 10:
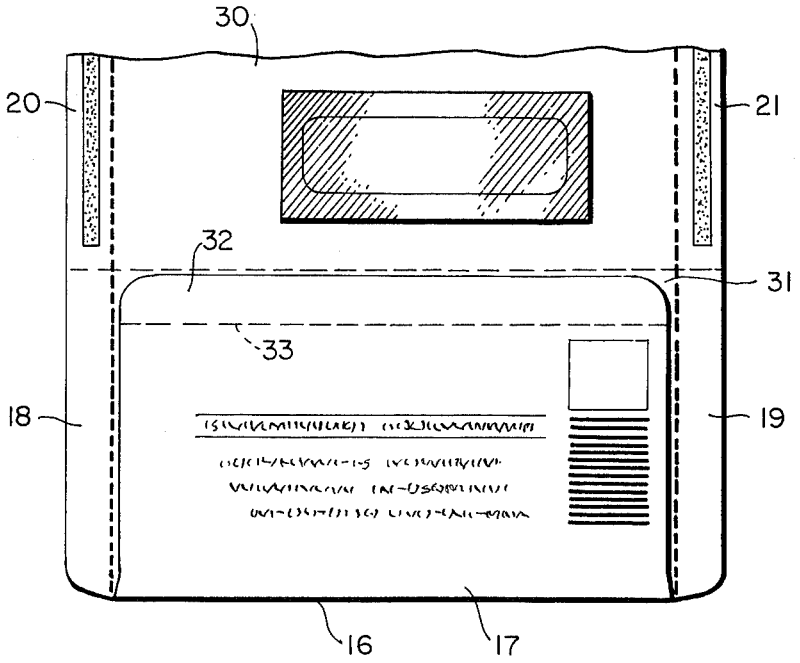
FIG. 10 shows the first folding step for the blank of FIG. 9.
Figure 11:
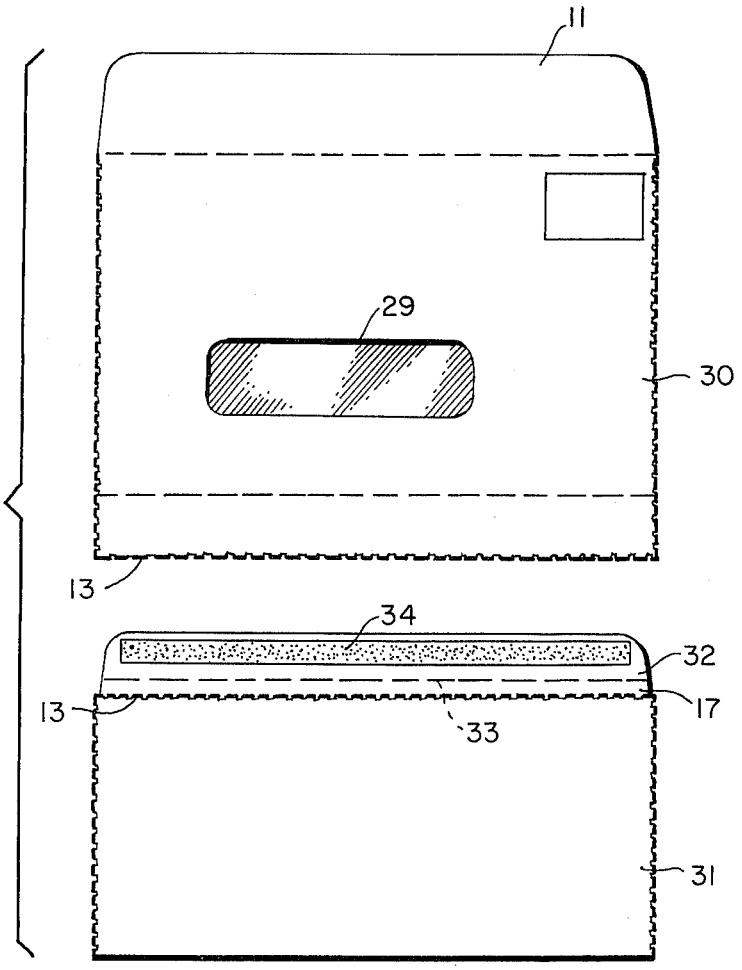
FIG. 11 illustrates the envelope constructed from the blank of FIG. 9 being prepared for its return mail mode.

A further modification of the basic blank structure is shown in FIG. 9. In this case, the second or return closure flap 32 is illustrated as being foldably attached to the top of return panel 17 along a score line 33. Adhesive 34 is applied to the closure flap 32 for the purpose of closing the return envelope. For this modification, the front and rear panels 30, 31 are foldably joined together along score line 15 and the same panels are separated from one another along transverse perforated line 13 located within rear panel 31. FIG. 10 shows the first folding step in the formation of the envelope and FIG. 11 shows the envelope turned over with side extensions 18, 20 and 19, 21 removed, and front panel 30 detached along perforated line 13. In this condition, the return envelope is ready for use.

Figure 12:
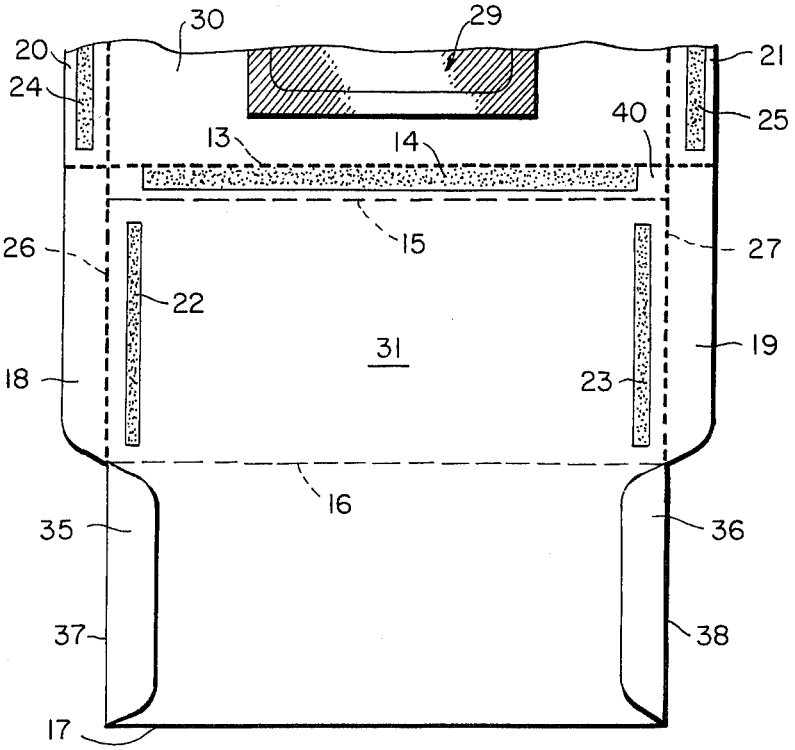
FIG. 12 is a partial plan view of a third modification for the blank used to construct the envelope of the present invention.
Figure 13:
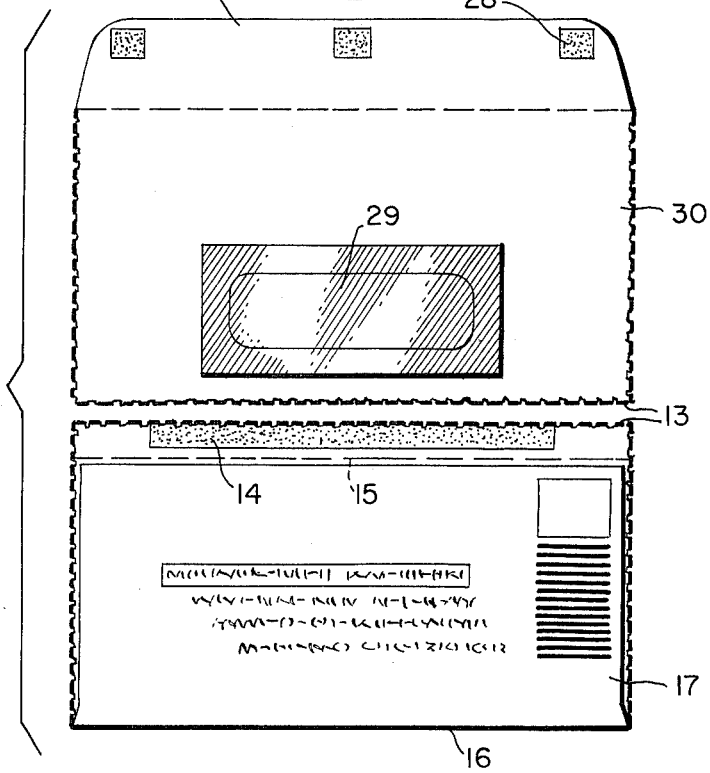
FIG. 13 shows the envelope made from the blank of FIG. 12 prepared for its return mail use.

In the case of the embodiments shown in FIGS. 12 and 13, and FIGS. 14 and 15, the basic blank structure has been modified to provide return envelopes having the same nominal width as the first envelope. For this purpose, and as shown in FIGS. 12 and 13, the blank initially illustrated in FIG. 5 has been provided with side closure flaps 35, 36 foldably attached to the side edges of return panel 17 along score lines 37, 38. Thus, when the side closure flaps 35, 36 are folded over as shown in FIG. 12 and the return panel 17 folded upwardly to be adhered to rear panel 31, a return envelope is created with a height from top to bottom measured by the distance between transverse score lines 15, 16, and a width from side to side measured by the distance between the parallel score lines 37, 38. Accordingly, when the front panel 30 is detached along perforated line 13 a substantially full width, but reduced height return envelope is created.

Figure 14:
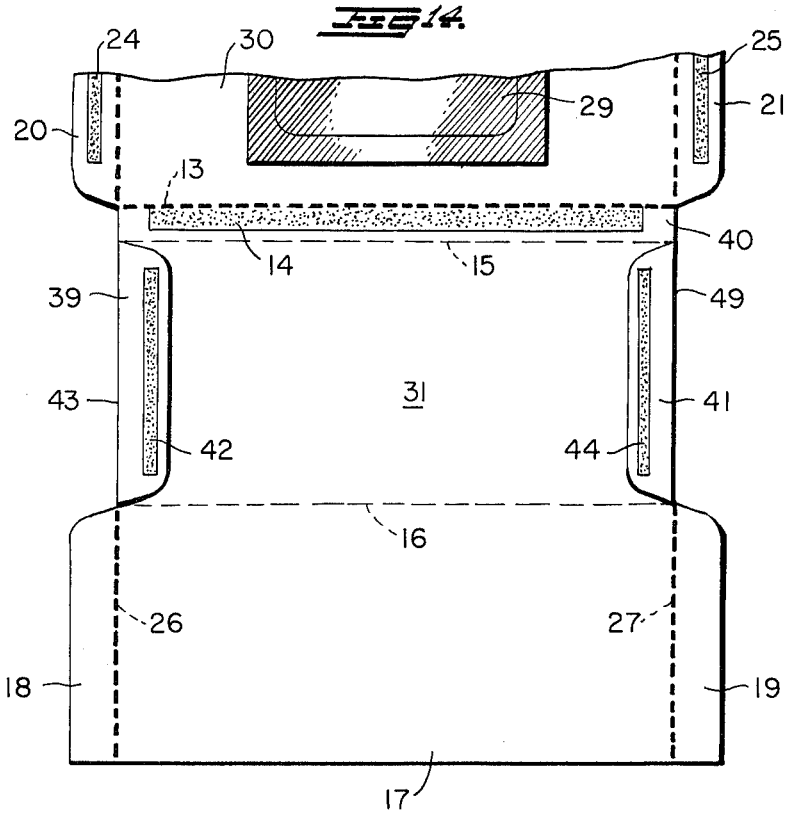
FIG. 14 is a partial plan view of a fourth modification for the blank used to make the envelope of the present invention.
Figure 15:
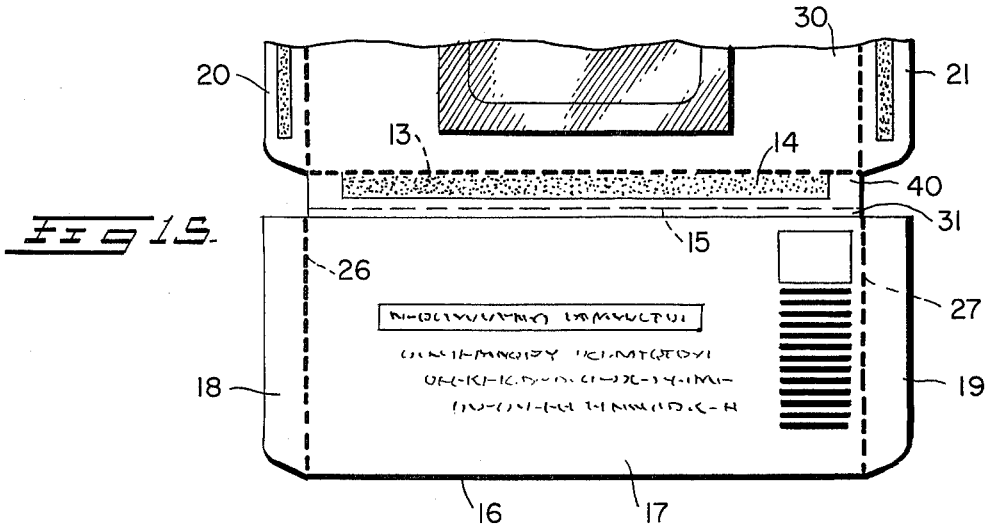
FIG. 15 shows a first folding step for the blank of FIG. 14.
Figure 16:
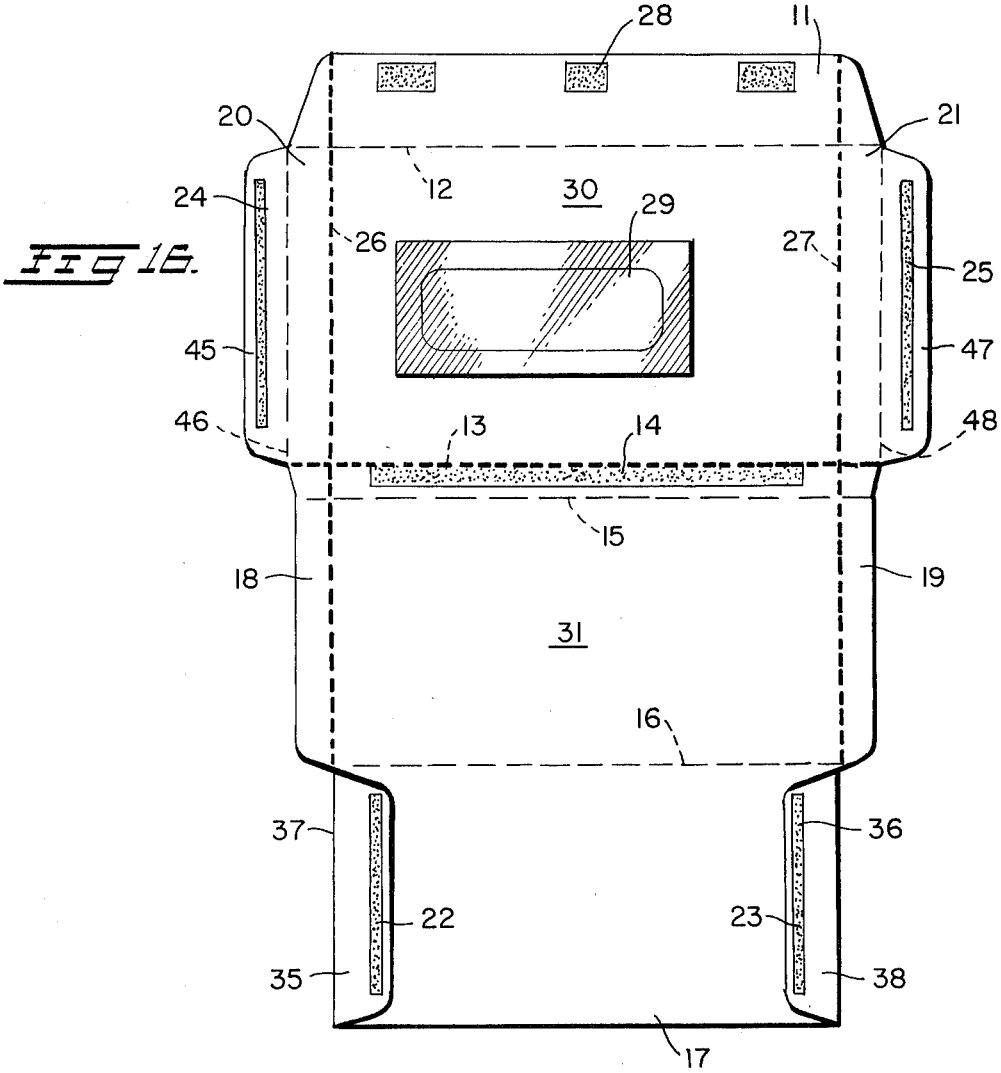
FIG. 16 is a plan view of a fifth modification for the blank used to make the envelope of the present invention.
Figure 17:
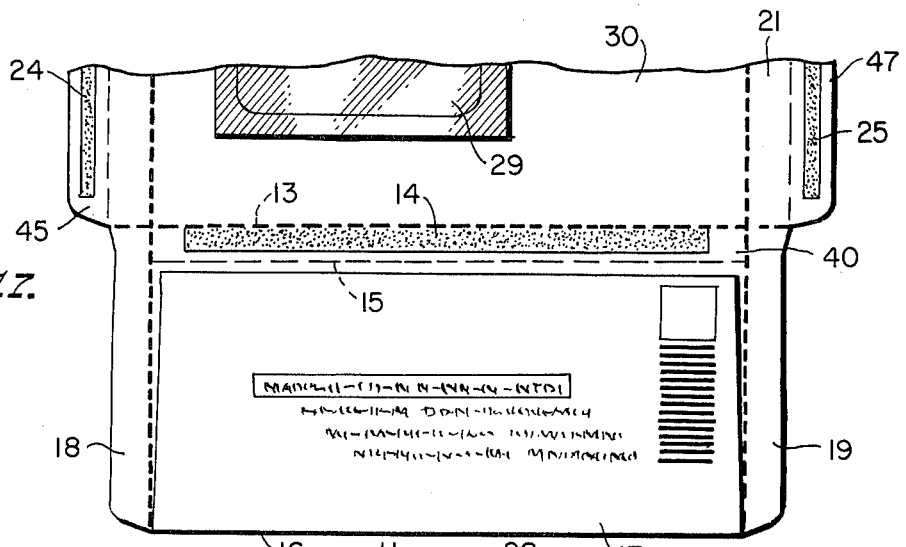
FIG. 17 shows a first folding step for the blank of FIG. 16.

The same basic construction is formed from the blank shown in FIGS. 14 and 15. However, in the latter case, side flaps 39, 41 are attached to the side edges of rear panel 31 along fold lines 43, 49, and adhesive is applied to those flaps at 42, 44. In addition, for this embodiment, the side extensions 18, 19 previously attached to rear panel 31 are moved down and attached to return panel 17. When the blank is folded as shown in FIG. 15, return panel 17 is adhered to flaps 39, 41 to form a return envelope with a full width permanent pocket, and subsequently, when return panel 17 and rear panel 31 are folded upwardly along perforated line 13, the side extensions 18, 20 and 19, 21 are adhered together to form the temporary pocket for the first envelope. The envelope of this embodiment is prepared for return substantially as shown for the other embodiments.

Figure 18:
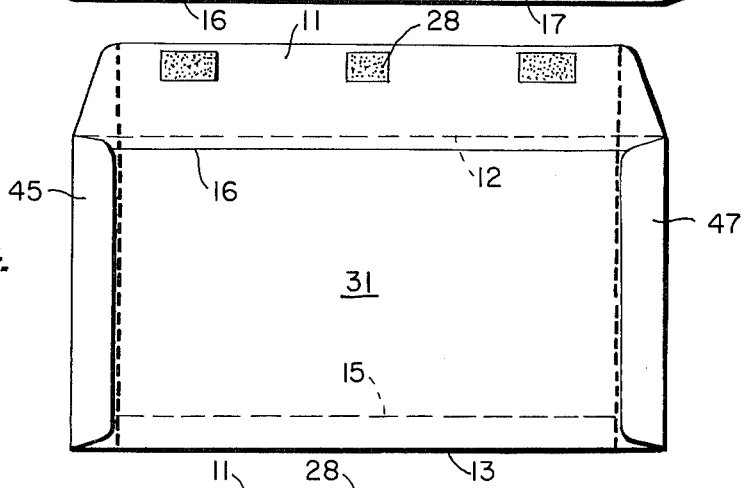
FIG. 18 shows a second folding step and rear view of the envelope constructed from the blank of FIG. 16.
Figure 19:
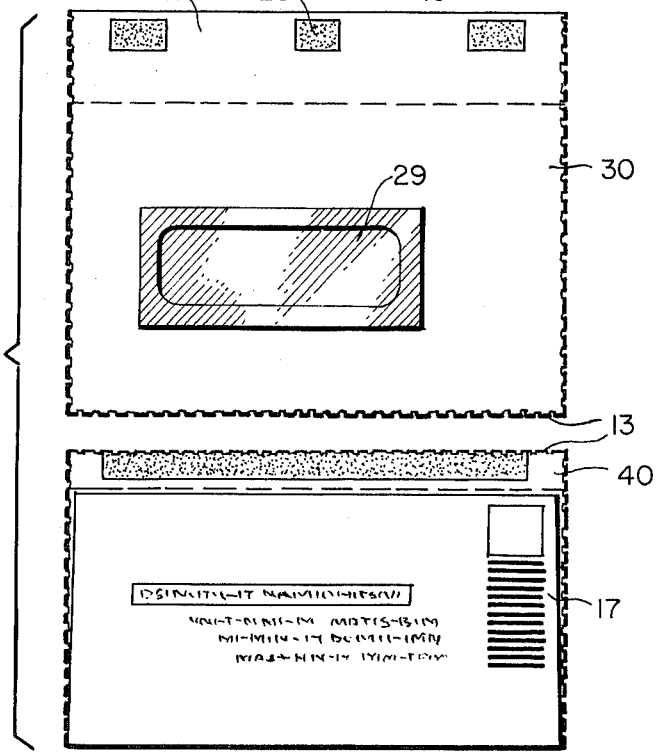
FIG. 19 shows the envelope made from the blank of FIG. 16 prepared for its return mail use.

The embodiment shown in FIGS. 16–19 is designed to yield a two way envelope construction with a permanent and substantially full width return pocket, and a first envelope with an even wider first pocket. These features are achieved in the first instance with the addition of side closure flaps 35, 36 to return panel 17 substantially as shown in FIGS. 12 and 13, and the addition of side closure flaps 45, 47 added to the side extensions 20, 21 of front panel 30. In this embodiment, the return envelope is formed substantially as before by folding the blank along score line 16 to bring the adhesive applied surfaces 22, 23 of side flaps 35, 36 into contact with the rear wall 31. Subsequently, the first envelope is formed, not by adhering side extensions 18, 20 and 19, 21 together as before, but by folding the flaps 45, 47 over along score lines 46, 48 and adhering these flaps to the side extensions. This step is shown in FIG. 18 and produces a first envelope with a temporary pocket having an effective width as measured between the score lines 46, 48. This example of the envelope structure according to the present invention can readily be opened by lifting flap 11 or by removing the side extensions along perforated lines 26, 27 to prepare the return envelope as shown in FIG. 19.

In each of the embodiments shown and described, the fundamental improvement of providing separate and completely enclosed pockets for first mailing and return, in a two way envelope, prepared from a single blank of envelope material, has been achieved. The side seaming technique is used to achieve this end primarily because it produces an envelope that is easy to open yet one which can be made on high speed equipment. Moreover the side seams add integrity to the envelope for improved automatic insertion and they add strength which inhibits inadvertent splitting of the envelope sides when it is inserted.

The principles of the invention have been fully described hereinbefore with the use of several embodiments. However, it will be understood that to those skilled in the art to which this invention relates, many other changes will suggest themselves without departing from the spirit and scope of the invention as defined in the appended claims.

We claim:

1. A combination mailing and return envelope having separate fully enclosed pockets for both first and return mailing, and formed from a single blank of paper or the like having inner and outer surfaces comprising a front panel for the first mailing envelope of generally rectangular shape having side, top, and bottom edges, a panel which serves as the rear panel for first mailing and return having substantially the same height and width as said front panel with side, top, and bottom edges, a return panel which serves as the front panel for return mailing having substantially the same width but less height than said front and rear panels with side, top, and bottom edges, a first score line extending transversely of said blank for joining said rear and return panels together, means substantially parallel to said first score line for joining said front and rear panels together, a closure flap for said first mailing envelope, said flap having substantially the same width but less height than said front panel and also having tapered side edges and a bottom edge foldably attached to the top edge of said front panel along a second score line substantially parallel to said first score line and provided with spaced adhesive patches, a second closure flap for said return envelope foldably attached to one of said rear or return panels along a third score line substantially parallel to said first score line and provided with an adhesive strip, means comprising strips of adhesive for adhering the side edges of said rear panel to the side edges of said return panel to form a permanent, fully enclosed pocket for said return envelope, detachable side extensions connected to the side edges of at least the front and rear panels along spaced apart, parallel perforated lines which extend generally longitudinally of said blank at each side of the blank wherein the side extensions connected to the front and rear panels are adhered together to form a fully enclosed pocket for said first mailing envelope, an insert included in the pocket for the first mailing and a third perforated line extending generally transversely of said blank for dividing the blank into its mailing and return portions, said construction defining a combination mailing and return envelope with detachable side extensions on at least two of its panels and having fully enclosed pockets for both first and return mailing wherein the rear panel is the same for both the first mailing and return envelopes.

2. The envelope of claim 1 wherein the third perforated line is located wholly within the front panel, terminating at its intersection with the spaced apart, parallel perforated lines at each side of the blank and the means for joining said front and rear panels together comprises the third score line that extends transversely of said blank and substantially parallel to said first score line.

3. The envelope of claim 1 wherein the third perforated line is located wholly within the rear panel, terminating at its intersection with the spaced apart, parallel perforated lines at each side of the blank and the third score line is located wholly within and near the top edge of the return panel.

4. The envelope of claim 1 wherein third perforated line comprises the means for joining said front and rear panels together and the third score line is located wholly within the rear panel, terminating at its intersection with the spaced apart, parallel perforated lines at each side of the blank.

5. The envelope fo claim 4 wherein said return panel is provided with flaps at the side edges thereof which are adhered to the rear panel to form the permanent pocket for said return envelope.

6. The envelope of claim 4 wherein the side extensions at the side edges of said front panel further include flaps which are folded over to adhere the side extensions of said front and rear panels together.

* * * * *